United States Patent [19]

Cox et al.

[11] 3,993,413

[45] Nov. 23, 1976

[54] ROAD PACKER

[76] Inventors: Ray N. Cox; Martin A. Parks, both of Star Rte. 1, Box 20, Fluvanna, Tex. 79517

[22] Filed: Apr. 25, 1975

[21] Appl. No.: 571,589

[52] U.S. Cl. ..... 404/128; 37/117.5; 172/452

[51] Int. Cl.[2] ..... E01C 19/26

[58] Field of Search ..... 404/128, 122, 124; 37/DIG. 3, DIG. 12, 117.5, 108 R; 172/400, 452, 417, 297,465, 484, 466, 483

[56] References Cited

UNITED STATES PATENTS

| | | | |
|---|---|---|---|
| 635,336 | 10/1899 | Miller | 404/128 |
| 1,330,531 | 2/1920 | Haynes | 404/128 X |
| 2,593,176 | 4/1952 | Patterson | 172/466 X |
| 2,650,528 | 9/1953 | Morgen | 172/465 |
| 2,721,405 | 10/1955 | Gardner | 404/128 X |
| 2,830,511 | 4/1958 | Wills | 404/128 X |
| 3,146,686 | 9/1964 | Grace | 404/128 X |
| 3,260,179 | 7/1966 | Moreira | 404/128 |
| 3,291,013 | 12/1966 | Stolp | 404/128 |
| 3,295,612 | 1/1967 | Mayo | 172/483 X |

*Primary Examiner*—Nile C. Byers, Jr.
*Attorney, Agent, or Firm*—Wendell Coffee

[57] ABSTRACT

A pneumatic tire-type compacter is mounted to be towed behind a road maintainer to pack the road immediately after it is graded. A single hydraulic cylinder raises the packer unit for maneuvering the grader; also, the hydraulic cylinder provides means for transferring weight from the maintainer onto the packer. Links between the maintainer and compacter provide proper operation. A small moldboard is attached to the compacter in front of the compacter to handle the dirt rolled from the maintainer.

6 Claims, 9 Drawing Figures

FIG. 1
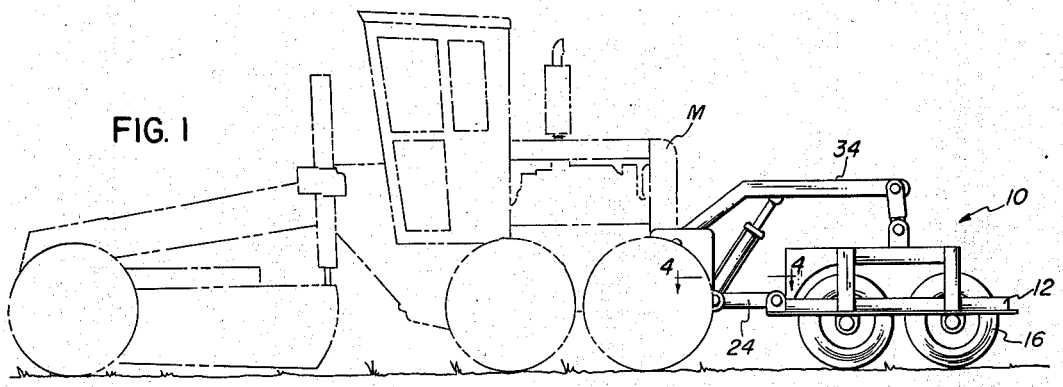
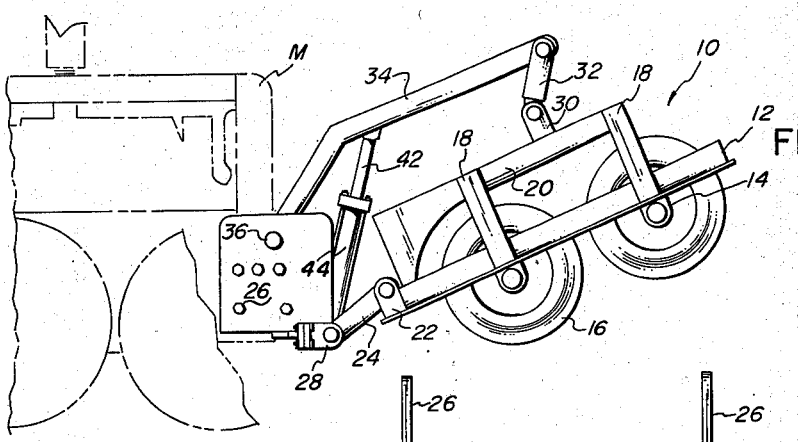
FIG. 2
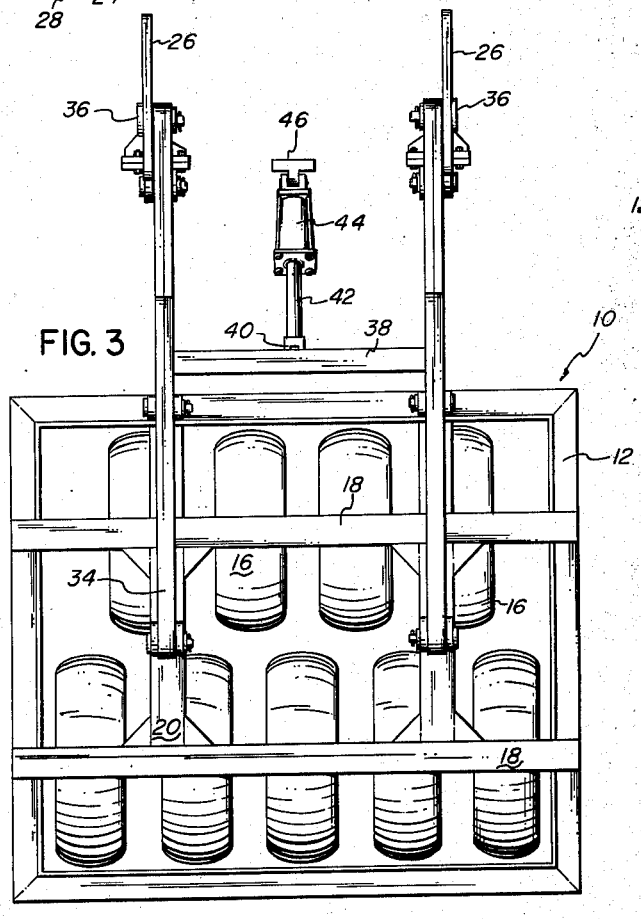
FIG. 3
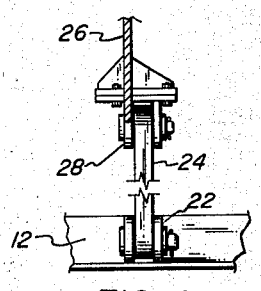
FIG. 4

FIG. 5
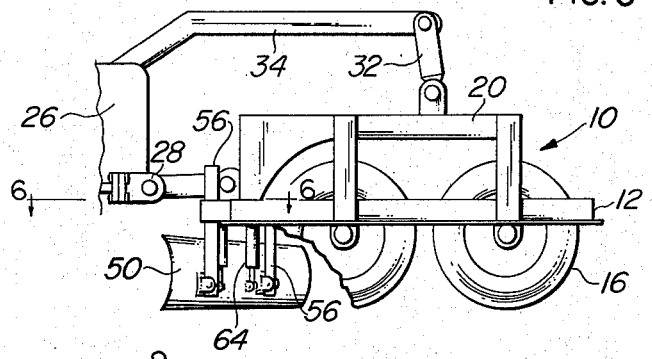
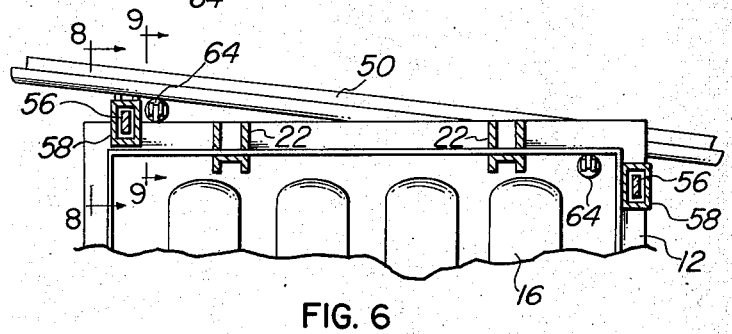
FIG. 6
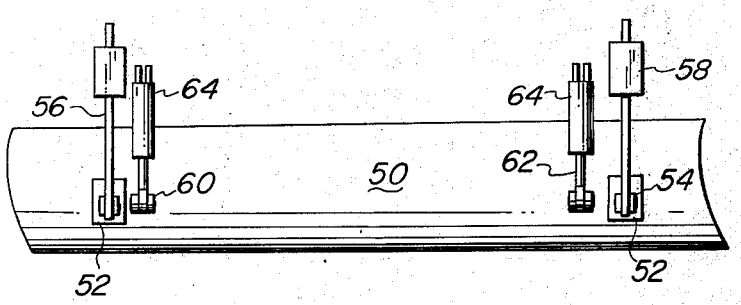
FIG. 7
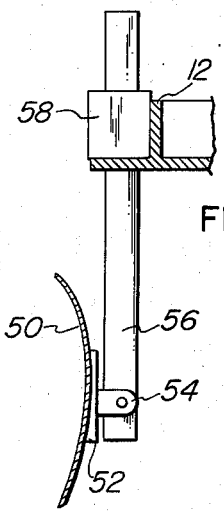
FIG. 8
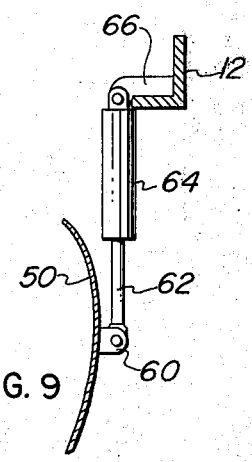
FIG. 9

ROAD PACKER

CROSS-REFERENCE TO RELATED APPLICATIONS

None. However, Disclosure Document No. 032545 was filed in the Patent Office on May 28, 1974, and a separate paper requesting transfer of that document to this application is filed herewith.

BACKGROUND OF THE INVENTION

1. Field of the Invention

This invention relates to road apparatus and more particularly to a packer having a plurality of rotating tires attached to a maintainer. (404/128)

2. Description of the Prior Art

STOLP, U.S. Pat. No. 3,291,013, has suggested attaching a wheel compacter or packer behind a maintainer or motor grader. He disclosed having the packer towed from the middle of the packer attached to a single pivot point connected to the motor grader. The packer was lifted by two hydraulic cylinders extending from the middle of the packer to a point substantially above the hitch on the motor grader. Inasmuch as the packer was towed by a pivot, each of the four connections of the hydraulic cylinders to the packer and motor grader were necessarily ball and socket joints or some other type of universal pivoting joint.

Also, the following U.S. Pat. Nos. were considered in preparing this patent application: OWENS ET AL, 2,127,485; SUMMERS, 2,270,390; HASTINGS 2,559,427, and PLAS, 2,685,777.

SUMMARY OF THE INVENTION

1. New and Different Function.

We have invented a packer to be attached to a motor grader wherein the packer is attached by pivoted links to two points on the motor grader and the packer is lifted or pushed down by a single cylinder working through pivoted links which are mounted at the center of the motor grader at the same level as the links. The cylinder acts against a yoke which extends to the packer. With this arrangement, the packer is attached to the grader by attaching two side plates on either side of the tool box of a conventional motor grader and and by changing the hitch behind the motor grader to a special mounting bracket for the hydraulic cylinder. In this way we simplify attaching the packer to the motor grader, reduce its expense and make it simpler to operate.

Furthermore, a small moldboard is attached to the front of the packer, It is angled in the opposite direction to the moldboard on the maintainer. Therefore, we are able to smooth out and level out the dirt of the maintainer so a full, complete operation may be carried on by one pass over the road in many cases. The small moldboard scraper or blade is attached by arms sliding in sleeves and is raised and lowered by a hydraulic cylinder on each side. Thus, not only the entire operation may be carried out by one pass over the road, but only one man is required for the entire operation.

2. Objects of this Invention.

An object of this invention is to pack roads immediately behind a motor grader.

Another object is to further smooth the dirt and pack it, all in a single operation.

Other objects are to achieve the above with a device that is sturdy, compact, durable, lightweight, simple, safe, efficient, maneuverable, versatile, and reliable, yet inexpensive and easy to manufacture, install, adjust, operate, and maintain.

The specific nature of the invention, as well as other objects, uses, and advantages thereof, will clearly appear from the following description and from the accompanying drawing, the different views of which are not to the same scale.

BRIEF DESCRIPTION OF THE DRAWING

FIG. 1 is a side elevational view of one embodiment of this invention shown in the packing position.

FIG. 2 is a side elevational view, to a larger scale, of the packer attached to a motor grader with the packer in the raised position, parts are broken away for clarity.

FIG. 3 is a top plan view of the packer shown above, the motor grader not being shown in this figure.

FIG. 4 is a detail of one of the draft links taken on line 4—4 of FIG. 1.

FIG. 5 is a side elevational view of a modification with a small moldboard attached to the packer with only a portion of the plate shown and with wheels of the packer broken away for clarity. Also, the hydraulic cylinder and draft links are not shown for clarity.

FIG. 6 is a top sectional view taken on line 6—6 of FIG. 5 showing the attachment of the small moldboard to the packer.

FIG. 7 is a back elevational view of the moldboard not attached to the packer.

FIG. 8 is a sectional view taken substantially on line 8—8 of FIG. 6 showing details of construction.

FIG. 9 is a sectional view taken substantially on line 9—9 of FIG. 6 showing details of construction.

DESCRIPTION OF THE PREFERRED EMBODIMENT

Packer 10, according to this invention, is basically conventional. I.e., it has a rectangular peripheral frame 12. (FIG. 3). To this rectangular frame 12 are mounted bearing blocks 14 to which are journaled shafts. A plurality of pneumatic tires 16 are mounted upon the shafts which pack the road. A super structure frame includes two beams 18 which extend above the tires immediately above the bearing blocks 14. Runners 20 are spaced about one-fourth from the sides. Stated otherwise, the distance between the two runners 20 is approximately half the width of the rectangular frame 12. As stated before, the packer as described to this point is purely conventional and the construction of such packer is well within the skills of those mechanics knowledgeable in the road building and maintaining arts.

A pair of ears 22 is mounted upon the rectangular frame 12 immediately forward of the connection of the runners 20 to the forward portion of the rectangular frame 12. Between the two ears on each side is connected draft link 24. The connection of the link between the ears may be accomplished by a pin as is customary in this art.

Two plates 26 are used. Each of the plates 26 is bolted to the frame of the motor grader by a plurality of bolts (six illustrated) at the lowest and most rear position it can be attached. Each of the two plates 26 is connected one on each side of the tool box of a conventional motor grader. At the lower, rear corner of each plate is attached a pair of plate draft ears 28. Each of the draft links 24 is pinned to the plate draft ears by a pin as is conventional in the art. Therefore, it may be seen that we have provided for the pulling or the draft of the packer 10. Also, particularly referring to FIG. 2, when the packer is in the raised position, the draft links 24 provide a certain flexibility so that the front tires 16 of the wheel packer 10 can be raised off the ground and the packer is not merely hinged to the rear of the motor grader M.

On each of the runners 20 and centered between the two beams 18 is a pair of press ears 30. The lower part of press or fork link 32 is attached to each of the press ears 30 by a pin, conventionally. The fork links are so referred inasmuch as they have two plates of metal which are spaced from one another at the top so yoke arm 34 may extend between the two plates. Another plate is welded between the two spaced-apart plates at the bottom so the bottom plate of the fork link 32 fits between the two press ears 30 of each pair, as stated before. As indicated, each of the yoke arms 34 is pinned, conventionally, to the top of the fork links 32. The forward end of each yoke arm extends to trunnion 36 which is securely and rigidly attached to the upper portion of each of the plates 26 at about the midpoint of the length of the plate (FIG. 2).

The two arms 34 are connected by yoke beam 38. The yoke beam 38 is located vertically above about the forward portion of the rectangular frame 12 which would be about vertically above the ears 22 thereon. At the midpoint of the beam 38 is located a boss to which is attached clevis 40 of the rod 42 of hydraulic cylinder 44. The hydraulic lines from the hydraulic cylinder 44 have not been shown for clarity of illustration, but it is understood that modern motor grader equipment and all modern road building equipment has a source of hydraulic pressure and these hydraulic lines can be connected thereto so the hydraulic cylinder 44 can be operated. It is understood that it is a double acting cylinder, being able to either lift the packer 10 through the yoke or push down on the packer 10 through the yoke. The bottom of the cylinder 44 is attached to a special lug 46 which is attached to the rear of the motor grader in lieu of the hitch normally located thereon. The replacement of a normal hitch with a lug for this purpose is well within the skill of ordinary mechanics of this art.

Therefore, it may be seen that the packer 10 may readily be raised to an elevated position, as seen in FIG. 2, so that the motor grader may be turned or backed into position when working around uneven grades, such as ditches and the like. Also, it may be seen that when in the normal operating position, as seen in FIG. 1, weight may be transferred from the motor grader through the yoke arms 34 onto the packer 10 itself. Specifically, we prefer to use a hydraulic cylinder capable of transferring approximately 5600 lbs (about 2500kg) of weight from the motor grader onto the packer 10. Specifically in the embodiment we have built we have found that a five-inch cylinder (about 12-1/2 cm) with a 16-inch (about 40 cm) stroke works well when operated upon normal pressures available, which are about 800 psi. (About 600 kg/cm$^2$). Specifically, it may be seen that the hydraulic cylinder will exert about 15,700 lbs of working force (about 7,150 kg) which will be about 5600 lbs of downward pressure at the press links or fork links 32.

As stated before, the links permit the packer to be raised in a more level position as seen in FIG. 2. One of the advantages of this is that a pickup, for example, may be towed behind the compacter when the compacter is either raised or lowered; this is particularly advantageous in certain types of operation.

Also, the unit is well adapted to have an earth-working blade or moldboard 50 mounted to the front of the peripherial frame 12 at about the ears 22. The blade 50 on the compacter 10 may be mounted and angled to move dirt opposite the direction dirt is moved by the blade on the motor grader and, thus, greatly incresing the usefulness and versatility of the complete unit.

Referring to and describing specifically the attachment of the blade 50 to the frame 12, it may be seen that two pads 52 are attached to the back of the blade 50. Pad ears 54 are attached to the pads. Arms 56 are pinned between the ears 54. There is a very small clearance between the arms 56, both above and below the pad ears 54. Therefore, referring specifically to FIG. 8, it may be seen that the arms 56 above the pad ear 54 will bear against the pad 52 to prevent the top of the blade 50 from rocking back excessively and, also, that the arm 56 below the pad ear 54 will bear against the bottom of the pad 52 to prevent the bottom of the blade from rocking excessively. The upper portion of the arms 56 are telescoped through sleeves 58 which are attached as by welding to the front portion of the frame 12. There are clearances between all of the joints. I.e., there is clearance between the pad ears 54 and the arm 56. Therefore, one end of the blade may be raised or lowered slightly more than the other end and this angling of difference in elevation between the edges of the blade 50 is accommodated by the clearance in the joints.

Adjacent to each of the pads 52 are mounted lift ears 60. The rod 62 from hydraulic cylinder 64 is pinned to lift ears 60. The top of the cylinder 64 is itself pinned to finger 66 which is attached as by welding to the frame 12.

As before, the hydraulic lines to the two cylinders 64 have not been shown for clarity inasmuch as any mechanic skilled in this art would understand how to attach the hydraulic lines thereto.

Also, road equipment operators are people experienced in maintaining roads and will understand how to adjust the cylinders 64 to maintain the blade 50 at the right position to properly manage the dirt to be packed by the tires 16.

Thus it may be seen that we have provoded a lightweight blade for this purpose.

It will be understood by those skilled in the art that the means for raising and lowering the leading edge or end of the blade, which is the hydraulic cylinder shown to the left of FIG. 6, is much more convenient to be a hydraulic cylinder. However it will be understood by those skilled in the art that on the trailing edge or end of the blade, which is the one shown on the right of FIG. 6, other means for raising and lowering the blade could be used, such as a crank with a screw on the end thereof or a pin extending through the sleeve 58 to a plurality of holes in the arm 56. Although a hole and a pin in the sleeve might be considered a means for maintaining a position once achieved, in the contex of this application, it is intended that it be understood as also designating a means for raising and lowering.

Thus it may be seen that we have developed a packer well adapted to pack roads immediately behind the motor grader and which is easily attached, operated and may be inexpensively built. The draft links 24 and the press links 32 provide flexibility, but still permit the yoke to push down on the compacter 10.

The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infrigement of this patent would be, but are to enable the reader to make and use the invention.

SUBJECT MATTER CLAIMED FOR PROTECTION

We claim as our invention:

1. In a pneumatic tire packer to the attached behind a motor grader, the packer having a. a rectangular peripherial packer frame having two shafts connected thereto, each shaft having a plurality of pneumatic tires mounted thereon;

b. THE IMPROVEMENT COMPRISING:

c. two plates adapted to be attached to each side of the motor grader, d. draft links interconnecting the packer frame to the plates, e. so that the packer is attached to two spaced-apart points to the plates, f. a yoke extending from two spaced-apart points on a superstructure of the packer frame to the plates, and g. a single hydraulic cylinder on the yoke adapted to be attached to the motor grader, h. so that the packer may be lifted or pressed down at two spaced-apart points.

2. The invention as defined in Claim 1 with additional limitations of j. a moldboard scraper blade, k. ears attached to the back of the blade, m. arms pivoted to the ears, n. a sleeve attached to the packer frame forward of said tires for each arm, o. each arm telescoped through its sleeve, and p. means interconnecting the blade and the frame for raising and lowering each end of said blade.

3. In a pneumatic tire packer to be attached behind a motor grader, the packer having a. a rectangular peripheral packer frame having tow shafts connected thereto, each shaft having a plurality of pneumatic tires mounted thereon;

b. THE IMPROVEMENT COMPRISING:

c. plates adapted to be attached to the motor grader, d. a yoke extending from the plates to above the packer frame, e. power means on the yoke for raising and lowering the yoke over the frame, f. at least one draft link i. pivoted to one of the plates and ii. pivoted to the rectangular frame, g. at least one press link i. pivoted to the yoke and ii. pivoted to s superstructure on the packer frame, h. so that the packer may be lifted or pressed down by the yoke.

4. The invention as defined in claim 3 with additional limitations of j. a moldboard scraper blade, k. ears attached to the back of the blade, m. arms pivoted to the ears, n. a sleeve attached to the packer frame forward of said tires for each arm, o. each arm telescoped through its sleeve, and p. means interconnecting the blade and the frame for raising and lowering each end of said blade.

5. In a pneumatic tire packer to be attached behind a motor grader, the packer having a. a rectangular peripheral packer frame having tow shafts connected thereto, each shaft having a plurality of pneumatic tires mounted thereon;

b. THE IMPROVEMENT COMPRISING:

c. a pair of plates adapted to be bolted to the side of the motor grader at the rear thereof, d. two pairs of ears on said packer frame, e. draft links pivoted to each pair of ears, f. a pair of ears on the lower part of each plate pivoted to one of said draft links, g. a yoke arm pivoted to the upper portion of each plate, h. each of said yoke arms extending rearwardly to the point midway between the shafts of the packer, j. a press link extending from each of the yoke arms to a superstructure on the packer, k. a yoke beam connecting the two yoke arms, m. a hydraulic cylinder attached to the yoke beam, and n. the lower portion of the hydraulic cylinder being adapted to attachment to the motor grader whereby the packer may be lifted or forced down by said hydraulic cylinder.

6. The invention as defined in claim 5 with additional limitations of o. a moldboard scraper blade, p. ears attached to the back of the blade, q. arms pivoted to the ears, r. a sleeve attached to the packer frame forward of said tires for each arm, s. each arm telescoped through its sleeve, and t. means interconnecting the blade and the frame for raising and lowering each end of said blade.

* * * * *